US006205607B1

(12) United States Patent
Tse

(10) Patent No.: US 6,205,607 B1
(45) Date of Patent: Mar. 27, 2001

(54) WATER DRIVEN CLEANING DEVICE WITH DOUBLE CLEANING ACTION

(76) Inventor: Robert W. Tse, 19417, Windrose Dr., Rowland Hts., CA (US) 91748

( * ) Notice: Subject to any disclaimer, the term of this patent is extended or adjusted under 35 U.S.C. 154(b) by 0 days.

(21) Appl. No.: 09/452,834

(22) Filed: Dec. 1, 1999

(51) Int. Cl.[7] ..... A46B 13/06
(52) U.S. Cl. ..... 15/29; 15/28
(58) Field of Search ..... 15/22.1, 23, 24, 15/28, 29

(56) References Cited

U.S. PATENT DOCUMENTS 4,181,997 * 1/1980 O'Rourke ..... 15/24
4,374,444 2/1983 Zhadanov .
4,679,270 7/1987 Gaiti et al. .
4,686,729 * 8/1987 Roman et al. ..... 15/29
4,734,954 * 4/1988 Greskovics et al. ..... 15/29
4,809,382 3/1989 Ravn .
4,856,133 * 8/1989 Sanchez ..... 15/29
5,007,127 4/1991 Paolo .
5,129,121 * 7/1992 Gelman ..... 15/29

* cited by examiner

*Primary Examiner*—Terrence R. Till

(57) ABSTRACT

A water driven cleaning device which comprises a housing with a water inlet, a nozzle, a turbine wheel which drives two concentric brushes in co-axial rotation simultaneously but in opposite directions via a gear transmission.

9 Claims, 3 Drawing Sheets

WATER DRIVEN CLEANING DEVICE WITH DOUBLE CLEANING ACTION

BACKGROUND OF THE INVENTION

There are inventions of water-driven wash brushes disclosed in U.S. Pat. No. 4,374,444 to Zhadanov; U.S. Pat. No. 4,679270 to Gaiti, et al; U.S. Pat. No. 4,809382 to Ravn; U.S. Pat. No. 5,007,127 to Paolo. All these water-driven wash brushes work with one or more brushes; which only rotate in the same direction at the same time on one single axle. But in daily life, when doing the normal cleaning job, the brush moves back and forth or up and down. This means the brush travels back and forth or up and down with two strokes, from point A to B and back from point B to A. While doing so, the forth stroke from point A to B, the bristles hit one side of the dirt that stick on the surface to be clean; and the backward stroke, the bristles hit the other side of the dirt. As a result of moving back and forth or up and down, it will remove the dirt much faster than just move the brush only in one direction from point A to B. According to the general principle of cleaning action mentioned above, this invention works with two concentric brushes rotating in opposite direction simultaneously; the brush A will do the forth stroke and the brush B will do the backward stroke at the same time. With this present invention, when the two concentric brushes unit travels from point A to B, the two back and forth strokes have already been carried out at the same time in one stroke by the two concentric brushes. So the job is done and there is no need to travel back from point B to A. With this invention, it can save half of the time in cleaning as well as half of water used while doing the same cleaning job; should be considered as an environmental friendly device.

BRIEF SUMMARY OF INVENTION

With present invention, a water-driven washing device works with two concentric brushes co-axially rotated simultaneously but in opposite direction via gear transmission. In result, this can save half of the time and using half of the water to do the same cleaning job. It is consider as an environmental friendly invention as well.

DETAILED DESCRITION OF THE INVENTION

Figure 1:
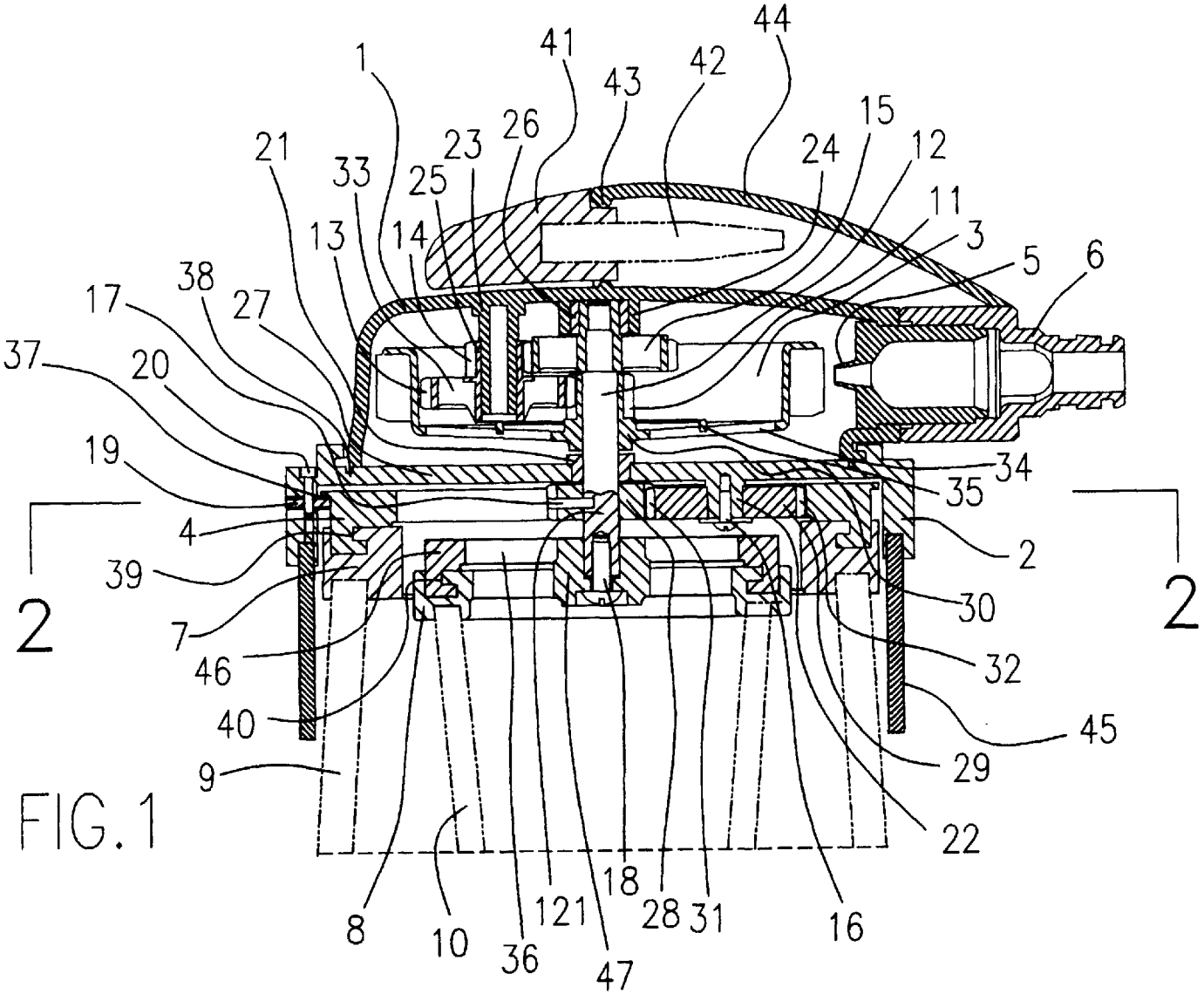
FIG. 1 is a cross section of the brush

A water-driven cleaning brush comprising: (a) top compartment 44 which hold the tight spot brush 41 with angled bristles 42 in place by a catch 43, and (b) an enclosed housing including an outer body 1 having a top, a peripheral side depending from said top, and (c) a collar 2 which is secured to the peripheral side of the body by means of a conventional bayonet connection 38, the collar including a lower bush 21 and spokes 27 which mount the lower bush 21 beneath a upper bush 26, and the collar 2 provide pins 20 to fix three rotary bearing rings 19 which are arranged to rotate at under side of the flanged part 37 of an internal crown gear 4. The three rotary bearing rings 19 also hold the internal crown gear 4 in place without dropping on top of an annular rotary platform 46. And (d) a water spill guard 45 is fixed to the collar 2 to minimize the water spill. And (e) a bladed impeller 3 disposed in the housing which is rotatably mounted, rotated by the water jet from a nozzle 5 which is fixed to the housing 1 by a grip of a water inlet 6 to be connected to a water feed hose, the bladed impeller 3 including a hub 30 having an integral toothed wheel 11.

The roof of the housing 1 is centrally provided with a socket 24 which by way of the upper bush 26 receive the end of shaft 12 from the end on which a center hub 47 of the annular rotary platform 46 is keyed and secured by a screw 18.

The annual rotary platform 46 which including three spokes 36 equally spaced angularly and are converging into the center hub 47. A center brush 8 is connected to the rotary annular platform 46 by means of a conventional bayonet connection 40.

A gear wheel 15 directly formed on the shaft 12 is interposed between the upper bush 26 and the hub 32 of a bladed impeller 3. The gear wheel 15 permanently engages with that teething 14 of smaller pitch circle diameter of a double gear 33. This later is rotatably mounted by way of a bush 25 on a pivot 23 projecting from the roof of the housing 1, and is kept in position by a ring 35 which connects together with spokes 34 of the bladed impeller 3.

The pitch circle diameter of the gear wheel 15 is double that of the smaller diameter teething of the double gear 33, and their meshing teeth are both of helical type. That teething 13 of larger pitch circle diameter of the double gear 33 engage with toothed wheel 11 provided on the hub 30 of the impeller 3. Of these two further teething, the former has a pitch circle diameter double that of the latter and both teething are straight tooth type.

In this manner, two successive reductions are obtained, with the center brush 8 and the connected annular rotary platform 46 rotating at rotational speed equal to one quarter the rotational speed of the impeller 3.

A sun gear 28 is secured by a pin 17 on the shaft 12 at portion 121. Planetary gears 29 are mounted on stationary posts 22 provided on spokes 27 and secured by a screw 16. The planetary gears 29 engage with teething 31, with sun gear 28 secured on shaft 12 on the one hand and the teething 32 of the internal gear 4 on the other hand. An outer annular brush 7 is connected to the internal crown gear 4 by means of conventional bayonet connection 39.

The pitch diameter of the internal crown gear 4 is larger than the diameter of the sun gear 28. A rotating reduction is obtained that the outer annular brush 7 will rotate slower with more torque than the center brush 8.

Figure 2:
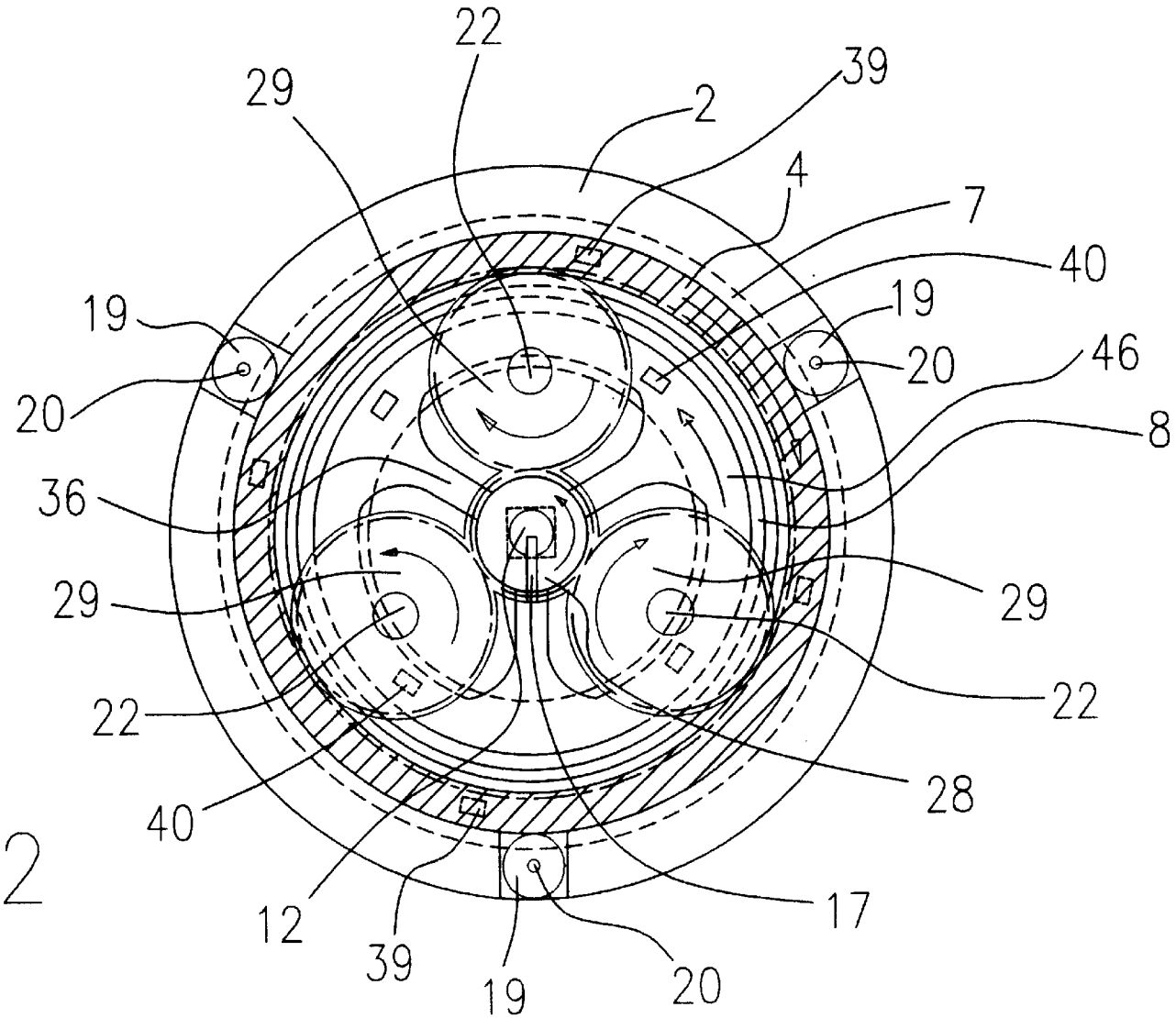
FIG. 2 is a section of line 2—2 of FIG. 1

FIG. 2 shown the rotation of the sun gear 28, as well as the center brush 8 which is connected to the annular rotary platform 46 The sun gear 28, the center brush 8 and the rotary platform 46, all three of them rotate in the same direction of the impeller 3. The outer annular brush 7 which connected to the internal crown gear 4 rotates in the opposite direction of the impeller 3 via the transmission of gear 28, 29, and 4. In result, when impeller 3 rotates under water pressure, the two connected concentric brushes, the center brush 8 and the outer annular brush 7 rotate in an opposite direction simultaneously.

Figure 3:
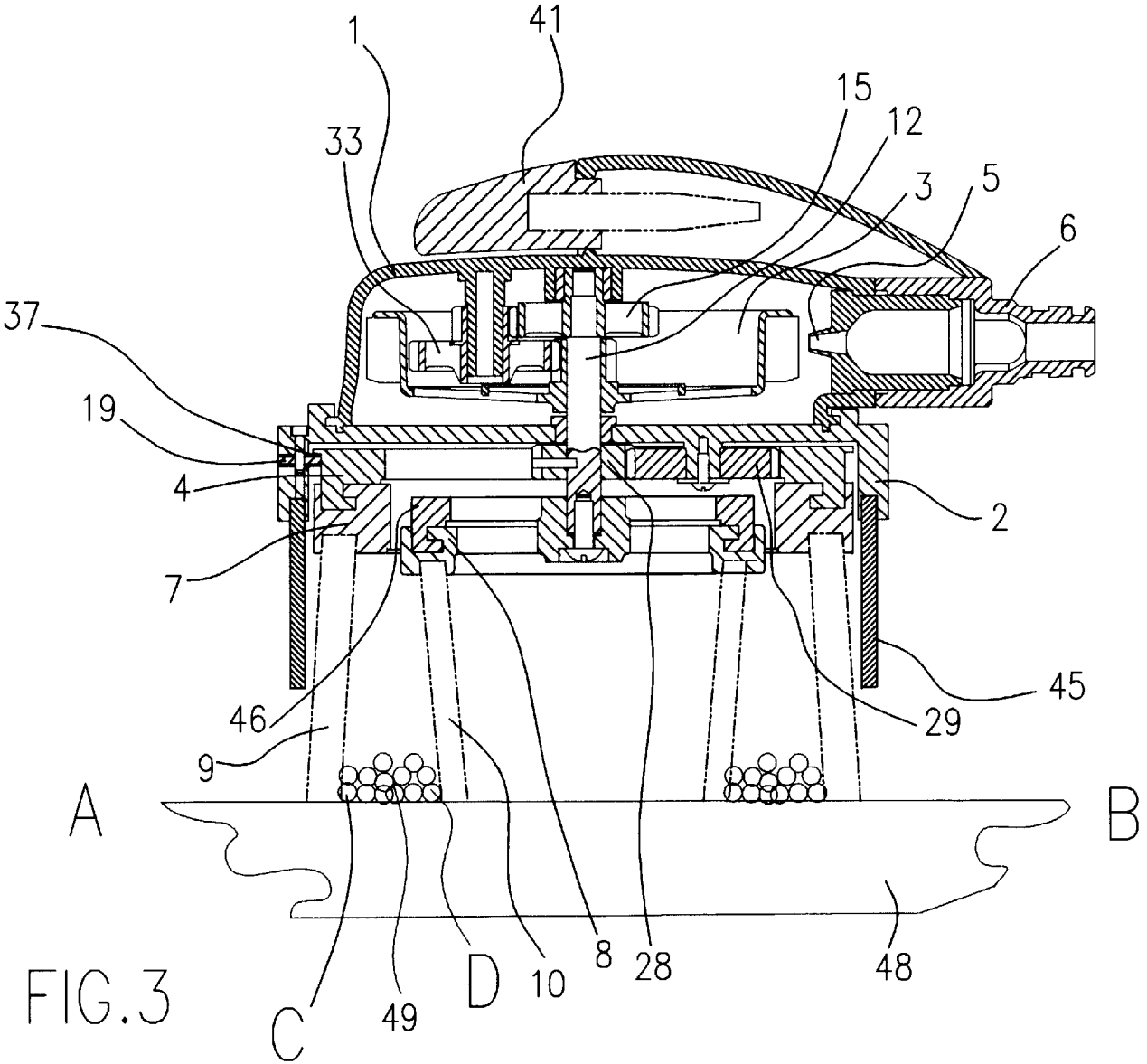
FIG. 3 shows the brushes member during the operation

FIG. 3 shown bristles 9 of the outer annular brush 7 work on C side of dirt 49 and bristles 10 of the center brush 8 work on D side of the dirt 49 with which both brushes clean both sides of the dirt 49 simultaneously that sticks on surface 48.

The inventive brush operates in the following manner when water under pressure is supplied into the inlet 6, it exits from the same under pressure onto the bladed impeller 3 rotates the same and the integral toothed wheel 11 engaged toothing 13 of the double gear 33, toothing 14 engaged with the gear wheel 15 which directly formed on the shaft 12 is interposed between the upper bush 26 and the hub 30 of the bladed impeller 3 and extended through the lower bush 21 which mounted on the center of collar 2 for connection of annular rotary platform 46, the center brush 8 which connected to the annular rotary platform 46 rotates the same direction of the impeller 3.

At portion 121 of shaft 12, the sun gear 28 is secured by the pin 17 and rotates in the same direction of the impeller 3 and the center brush 8. The outer annular brush 7 which is connected to internal crown gear 4 rotate in the opposite direction via transmission of gear 28, 29 and 4.

Brush 7, 8 is simultaneously rotated co-axially but in opposite direction which bristles 9 of the outer annular brush 7 work on the C side of the dirt 49 and bristles 10 of center brush 8 work on the D side of the dirt 49 which stick on the surface 48 to be clean. When this inventive brush travels from point A to point B, the double cleaning action is carried out by the two concentric brushes at the same time.

The water driven brush according to the invention permits an time efficient, water saving and strong cleaning of surfaces of any nature including kitchen sink, bathtub, window, wall, floor, car and the alike.

Drawing Reference Numeral Worksheet

| PART NAME |
|---|
| 1. Enclosed Housing Outer Body |
| 2. Collar |
| 3. Bladed Impeller |
| 4. Internal Crown Gear |
| 5. Nozzle |
| 6. Water Inlet |
| 7. Outer Annular Brush |
| 8. Center Brush |
| 9. Bristles Of Outer Annular Brush |
| 10. Bristles Of Center Brush |
| 11. Integral Toothed Wheel |
| 12. Shaft |
| 13. Teething |
| 14. Teething |
| 15. Gear Wheel |
| 16. Screw |
| 17. Pin |
| 18. Screw |
| 19. Bearing Rings |
| 20. Pins |
| 21. Lower Bush |
| 22. Stationary Posts |
| 23. Pivot |
| 24. Socket |
| 25. Bush |
| 26. Upper bush |
| 27. Spokes |
| 28. Sun Gear |
| 29. Planetary Gears |
| 30. Hub |
| 31. Teething |
| 32. Teething |
| 33. Double Gear |
| 34. Spokes |
| 35. Ring |
| 36. Spokes |
| 37. Flanged Part Of Internal Crown Gear |
| 38. Conventional Bayonet Connection |
| 39. Conventional Bayonet Connection |
| 40. Conventional Bayonet Connection |
| 41. Tight Spot Brush |
| 42. Angled Brush Bristles |
| 43. Catch |
| 44. Top Compartment |
| 45. Water Spill Guard |
| 46. Annular Rotary Platform |

-continued

Drawing Reference Numeral Worksheet

| PART NAME |
|---|
| 47. Center Hub |
| 48. Surface |
| 49. Dirt |
| 121 Portion |

I claim:

1. A water driven cleaning device comprising: a shell-shaped housing, a top compartment (44), a tight spot brush (41), an enclosed top (1) with an open bottom, a collar (2) secured at the open bottom by means of conventional bayonet connection (38), a water inlet (6), a bladed impeller (3) mounted for rotation and generally coaxially in said housing, nozzle (5) means converging into said housing for directing water generally tangentially onto the bladed impeller (3) to drive the impeller in rotation, said open bottom of the housing defining an outlet for water from said nozzle so that the water flows along a flow path from the impeller and then through said outlet, two rotary concentric brushes adjacent said open bottom housing, an outer annular brush (7) which is connected to an internal crown gear (4) surrounding a center brush (8) which is connected to an annular rotary platform (46), reduction gear means connecting said impeller (3) to the said center brush (8) for driving said center brush (8) in rotation at a speed less than the speed of rotation of the impeller (3), planetary gear means connecting said impeller (3) to the rotary outer annular brush (7) for driving said brush in opposite direction of said center brush (8).

2. A water driven cleaning device according to claim 1 wherein, said collar (2) is provided with three rotary bearing rings.

3. A water driven cleaning device according to claim 2 wherein, said three bearing rings (19) are arranged to rotate at the under side of a flanged part (37) of said internal crown gear (4).

4. A water driven cleaning device according to claim 3 wherein, said three rotary bearing rings (19) hold the internal crown gear (4) in place without dropping on top of said annular rotary platform (46).

5. A water driven cleaning device according to claim 1 wherein, an integral top compartment consists of a tight spot brush (41) which is kept in place by a catch (43), bristles (42) of said spot brush are angled to form a narrow tip for tight spot cleaning.

6. A water driven cleaning device according to claim 1 wherein, the two individual concentric rotary brushes (7) (8) are secured by a conventional bayonet connection (39) (40).

7. A water driven cleaning device according to claim 1 wherein, the two rotary brushes (7) (8) are co-axially rotated.

8. A water driven cleaning device according to claim 7 wherein, the two rotary brushes (7) (8) are co-axially rotated simultaneously but in opposite direction.

9. A water driven cleaning device according to claim 1 wherein, a water spill guard (45) is fixed to the collar (2) that brings the water spills to a minimum.

* * * * *